US012146282B2

(12) United States Patent
Volkwein

(10) Patent No.: US 12,146,282 B2
(45) Date of Patent: Nov. 19, 2024

(54) SAFETY NET FOR ROCKFALL PROTECTION BARRIERS

(71) Applicant: Trumer Schutzbauten Ges.m.b.H, Oberndorf (AT)

(72) Inventor: Axel Volkwein, Birmensdorf (CH)

(73) Assignee: Trumer Schutzbauten Ges.m.b.H, Oberndorf (AT)

( * ) Notice: Subject to any disclaimer, the term of this patent is extended or adjusted under 35 U.S.C. 154(b) by 91 days.

(21) Appl. No.: 17/998,921

(22) PCT Filed: May 11, 2021

(86) PCT No.: PCT/EP2021/062517
§ 371 (c)(1),
(2) Date: Nov. 15, 2022

(87) PCT Pub. No.: WO2021/228879
PCT Pub. Date: Nov. 18, 2021

(65) Prior Publication Data

US 2023/0212832 A1 Jul. 6, 2023

(30) Foreign Application Priority Data

May 15, 2020 (DE) ..... 102020113269.7

(51) Int. Cl.
*E01F 7/04* (2006.01)

(52) U.S. Cl.
CPC ..... *E01F 7/045* (2013.01)

(58) Field of Classification Search
CPC ..... E01F 7/04; E01F 7/045
(Continued)

(56) References Cited

U.S. PATENT DOCUMENTS 5,299,781 A * 4/1994 Barrett ..... E01F 7/045 256/12.5
6,592,103 B2 * 7/2003 Sennhauser ..... E01F 7/045 256/12.5

(Continued)

FOREIGN PATENT DOCUMENTS

AT 503574 A4 3/2005
CH 676259 A5 * 12/1990 ..... E01F 7/045

(Continued)

OTHER PUBLICATIONS

International Search Report and Written Opinion of the International Searching Authority from the European Patent Office, in PCT/EP2021/062517 dated Aug. 18, 2021, which this application claims priority.

(Continued)

*Primary Examiner* — Josh Skroupa
(74) *Attorney, Agent, or Firm* — KOLITCH ROMANO DASCENZO GATES LLC

(57) ABSTRACT

A safety net for rockfall protection barriers includes two outer supports anchored to the slope or rock and at least two inner supports anchored to the slope or rock. Rope guide elements are arranged at the upper and lower ends of the outer and inner supports for respectively two upper net body load-bearing ropes and two lower net body load-bearing ropes. Respectively one of the two upper net body load-bearing ropes runs through a rope guide element of the inner supports and one of the two lower net body load-bearing ropes runs through a rope guide element of the inner supports and is guided past neighboring upper and lower rope guide elements of the inner supports.

3 Claims, 4 Drawing Sheets

(58) Field of Classification Search
USPC ..... 256/12.5
See application file for complete search history.

(56) References Cited

U.S. PATENT DOCUMENTS

| | | | | |
|---|---|---|---|---|
| 7,188,825 | B2 * | 3/2007 | Sennhauser | E01F 7/045<br>256/12.5 |
| 11,015,309 | B2 * | 5/2021 | Song | E01F 7/045 |

FOREIGN PATENT DOCUMENTS

| | | | | |
|---|---|---|---|---|
| DE | 2428074 | A1 * | 12/1975 | E01F 7/045 |
| EP | 484563 | A1 | 5/1992 | |
| EP | 1500747 | A1 * | 1/2005 | E01F 7/045 |
| EP | 1516964 | A1 | 3/2005 | |
| EP | 2725139 | A1 * | 4/2014 | E01F 7/045 |
| EP | 3143209 | B | 3/2018 | |
| FR | 1190613 | A * | 10/1959 | E01F 7/04 |
| FR | 2984375 | A1 * | 6/2013 | E01F 7/045 |

OTHER PUBLICATIONS

"European Technical Assessment ETA 14/0362 Test Certificate No. S 14-4 Federal Office for Environment FOEN Switzerland RCE-3000 Rockfall Barrier"; obtained at https://warco.com.co/wp-content/uploads/2018/12RXE-3000-Product-Manual_EN.pdf; Oct. 8, 2018.

* cited by examiner

SAFETY NET FOR ROCKFALL PROTECTION BARRIERS

FIELD

The present disclosure relates to a safety net according to the preamble of claim 1.

INTRODUCTION

In a safety net described in EP 0 484 563 A1, two upper net body suspension ropes and two bottom ropes are longitudinally slidably guided in or on bottom supports, with all suspension and bottom ropes running through rope guide elements arranged at the upper and lower ends of the bottom supports. Sections lying between adjacent outer and inner supports are referred to as suspension rope portions. The net body is connected in each successive suspension rope portion with the other of the two upper suspension ropes and with the other of the two bottom ropes in such a way that, in the event of impact, in particular of a larger stone, a load is applied to the net body and thus to the upper suspension ropes or bottom ropes essentially within a suspension rope portion, which results in an unfavorable load distribution as well as an unfavorable flow of forces through the net body.

EP 1 516 964 B1 describes a safety net, whose net body consisting of interlocking rings is slidably held along its upper and lower longitudinal sides respectively on an upper and lower load-bearing rope extending between at least four supports and four bottom elements. The two load-bearing ropes are slidably guided in their longitudinal direction at the upper and lower ends of the supports and in rope guide elements of the bottom elements, with which the support posts are anchored in the slope or at the rock, and are tensioned laterally. In the area of each support, a running rope is provided, which bypasses the respective support, which is attached to the net load-bearing rope with one end to one side of the support and with the other end to the other side of the support, and is held slidably at the running ropes in the support area.

In another known safety net (according to ETA 14/0362), two rope types are provided respectively for the upper and lower net longitudinal sides. An upper and a lower load-bearing rope strand are guided and laterally tensioned respectively by rope guide elements at the upper ends of the supports and by rope guide elements in the area of bottom elements. The second upper and lower rope type is guided only in rope guide elements of the upper ends of the outer supports and the outer bottom elements and bypasses rope guide elements assigned to the inner supports and the middle bottom plates.

SUMMARY

The object of the present disclosure is to create a safety net in order to achieve an improved load distribution in the event of a rockfall compared to the state of the art, as well as a more favorable flow of forces through the net body and a more uniform deformation structure.

The safety net of the present disclosure is described below with reference to FIGS. 3*a*, 3*b* and 4:

DETAILED DESCRIPTION

Figure 1A:
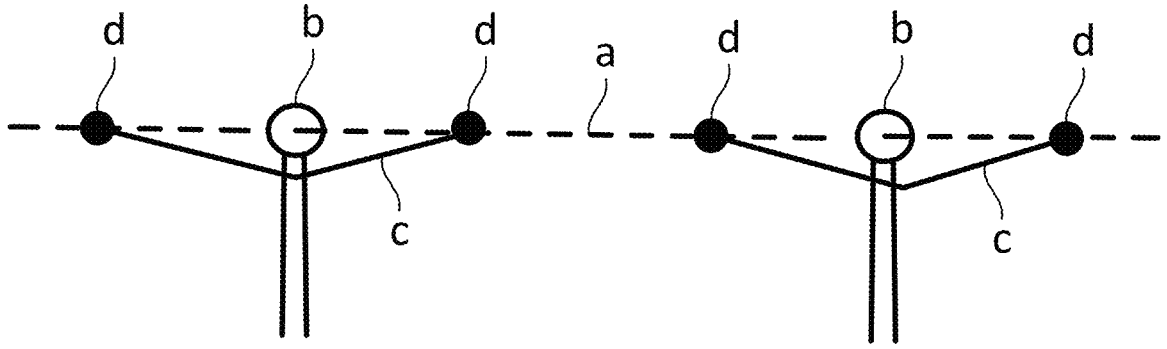
FIG. 1*a* shows a schematic diagram of the rope run of the safety net described in EP 1 516 964 only in the area of the upper longitudinal side of the net body in the unloaded state.

In the safety net according to EP 1 516 964 B1 shown in FIG. 1*a* in the unloaded state, the load-bearing rope a runs through all the rope guide elements b. Additional running ropes c are clamped to the load-bearing rope a with their ends at points d on both sides of the rope guiding element b. The net body, which is not shown, is slidable along the load-bearing rope a and the running ropes c.

Figure 1B:
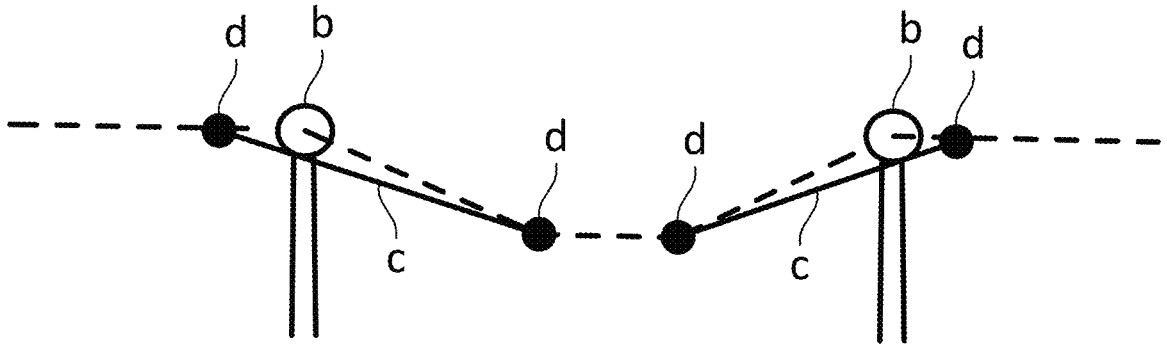
FIG. 1*b* shows the rope run of a safety net according to FIG. 1*a* in the loaded condition.

FIG. 1*b* illustrates the safety net according to EP 1 516964 B1 in the loaded state.

Figure 2A:
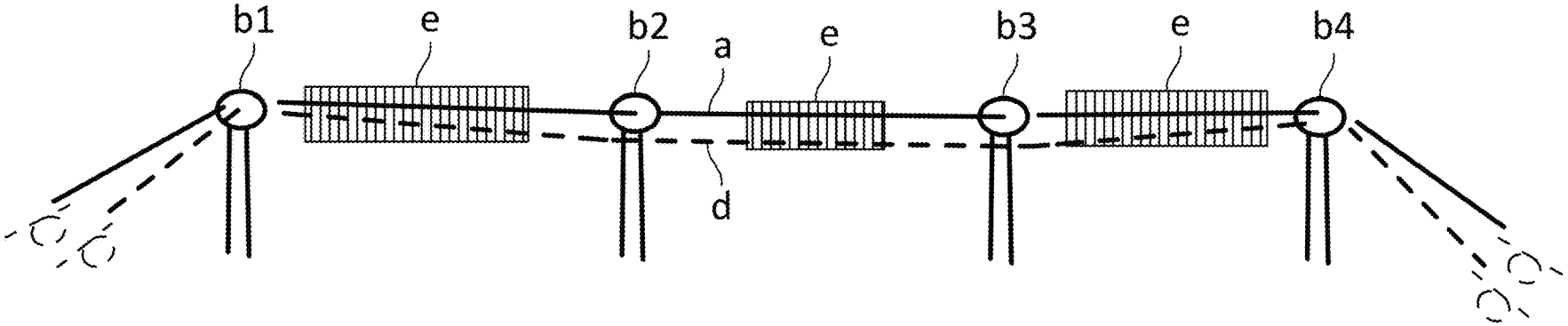
FIG. 2*a* shows the rope run of a safety net according to ETA 14/0362 only in the area of the upper longitudinal side of the net body in the unloaded state.
Figure 2B:
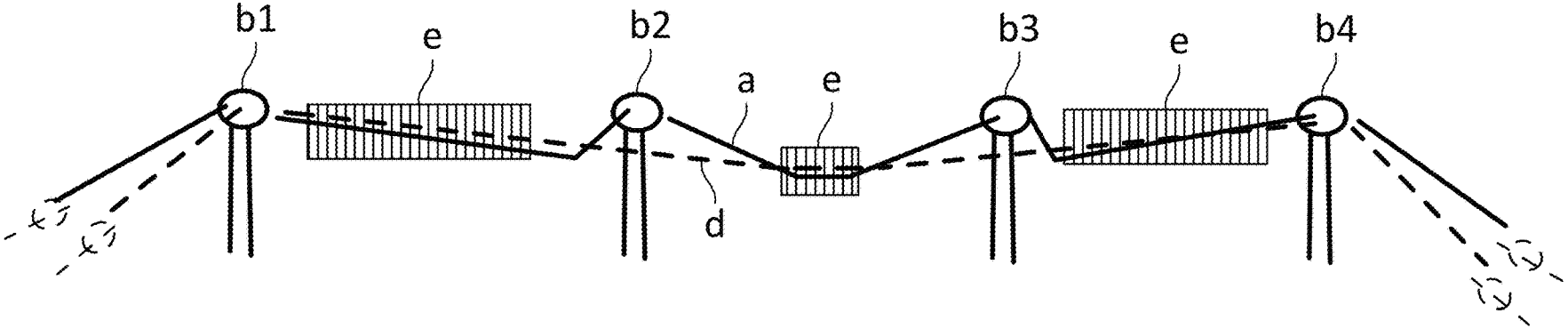
FIG. 2*b* shows the rope run of a safety net according to FIG. 2*a* in the loaded condition.

FIG. 2*a* shows the rope run of another known safety net according to ETA 14/0362 in the unloaded state. The laterally tensioned load-bearing rope a shown in solid lines runs through all rope guide elements b1 to b4. The laterally tensioned load-bearing rope d shown in dashed lines only runs through the two outer rope guide elements b1 and b4 and bypasses the two middle rope guide elements b2 and b3. Both load-bearing ropes a and b are connected via connecting elements e.

Figure 3A:
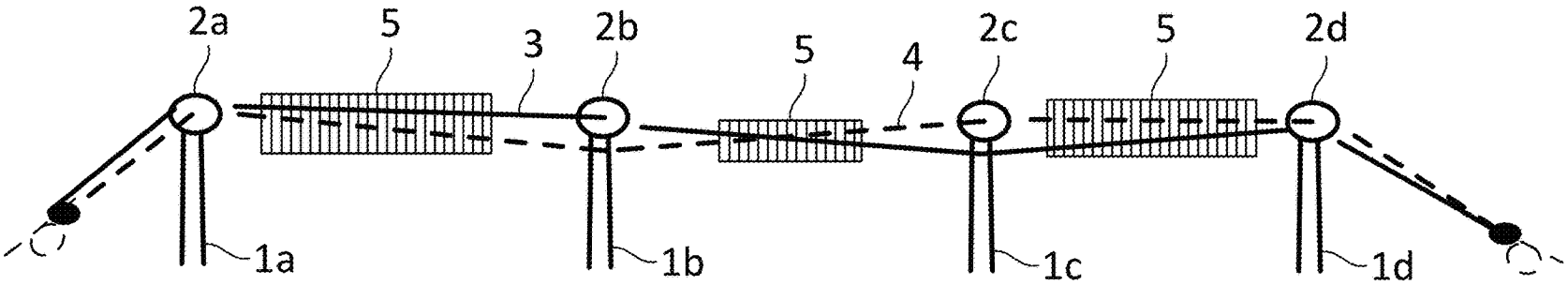
FIG. 3*a* shows in schematic form the rope run of the safety net according to the present disclosure only in the area of the upper longitudinal side of the net body in the unloaded state.
Figure 3B:
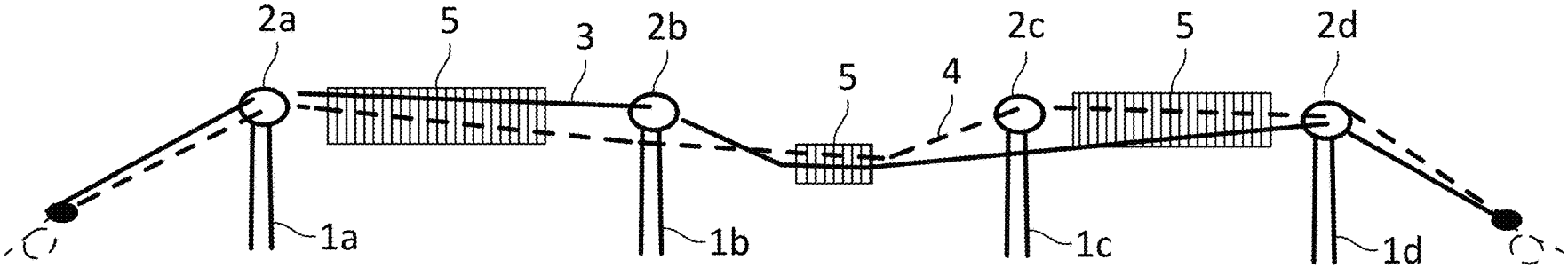
FIG. 3*b* shows the rope run of the safety net according to FIG. 3*a* in the loaded condition.
Figure 4:
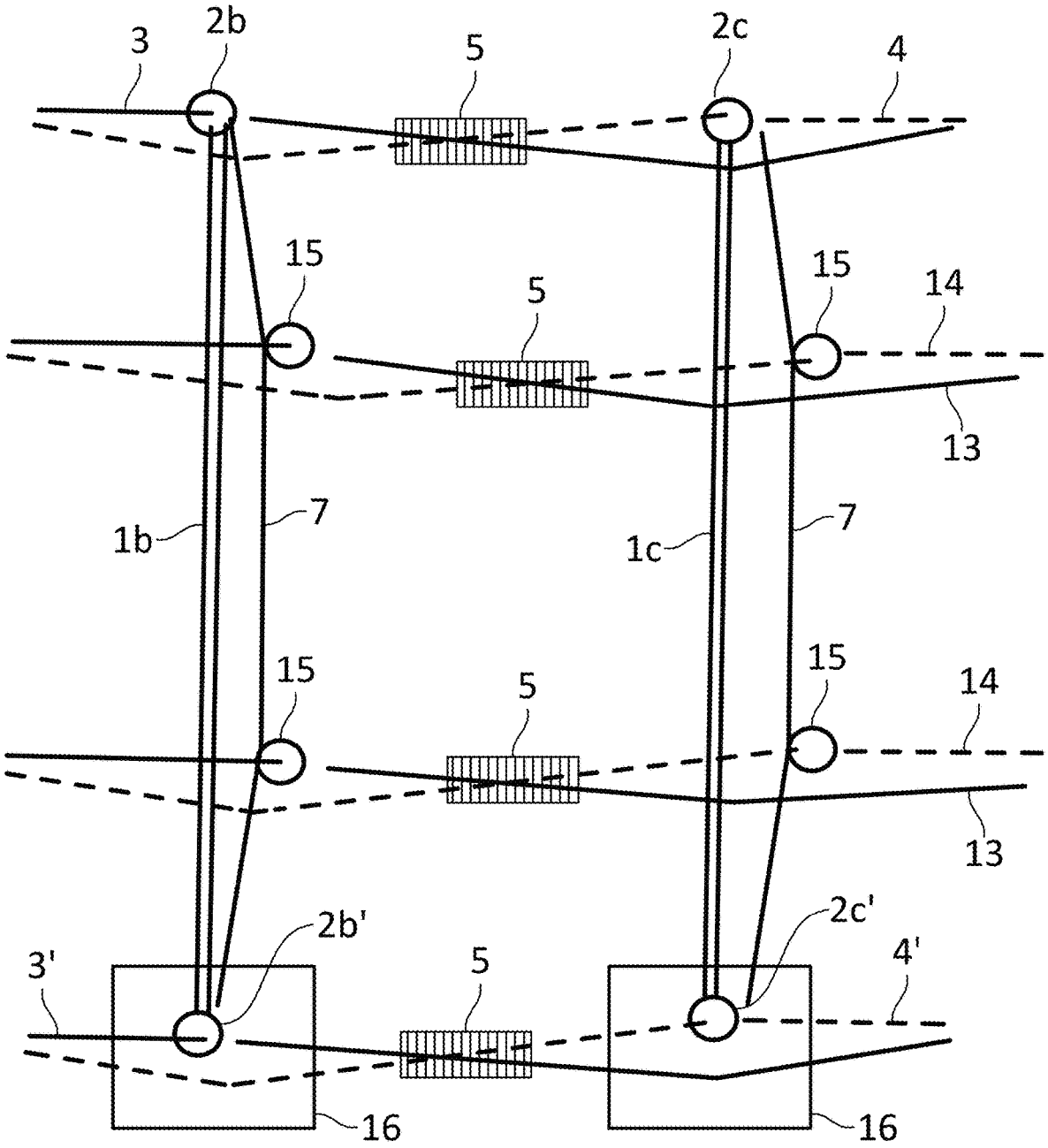
FIG. 4 shows a schematic enlarged view of the rope run of the safety net according to FIG. 3 in the unloaded state.

FIGS. 3*a*, 3*b* and 4 show a schematic diagram of the rope or cable run in the region of the upper and the lower net longitudinal sides of a net body of the safety net according to the present disclosure, which is not shown. The present disclosure also comprises safety nets with two or four inner supports.

As shown, the safety net according to the present disclosure comprises two outer supports 1*a* and 1*d* and two inner supports 1*b* and 1*c*. Upper rope guide elements 2*a*, 2*b*, 2*c* and 2*d* are provided at the outer and inner supports 1*a*, 1*b*, 1*c*, 1*d*.

The upper primary load-bearing rope 3, shown in solid lines and tensioned at the side ends, runs through the two outer, upper rope guide elements 2*a* and 2*d* and the inner, upper rope guide element 2*b*.

The upper secondary load-bearing rope 4 shown with dashed line and tensioned laterally at the ends runs through the two outer rope guide elements 2*a* and 2*d* and the inner rope guide element 2*c*.

Although only the two inner supports 1*b* and 1*c* are shown in FIG. 4, bottom elements 16 are provided for all outer and inner supports 1*a*, 1*b*, 1*c*, 1*d* to anchor the outer and inner supports to the slope or rock. Laterally tensioned lower primary load-bearing ropes 3' and secondary load-bearing ropes 4' alternately run through the lower rope guide elements 2*b* ' and 2*c*', respectively, or alternately bypass these rope guide elements, in the manner shown in FIG. 4.

According to the teaching of EP 3 143 209 B1, as shown in FIG. 4, a pull rope 7 and at least one middle primary load-bearing rope 13 and at least one associated middle secondary load-bearing rope 14 are provided. The middle primary and secondary load-bearing ropes 13 and 14 are tensioned laterally at the ends.

Central rope guide elements 15 are attached to the pull elements 7. The middle primary load-bearing ropes 13 and the middle load-bearing supporting ropes 14 alternately run through the adjacent middle rope guide elements 15 in the longitudinal direction of the net or bypass them.

The upper and lower primary and secondary load-bearing ropes 3, 4 and 3', 4' respectively are connected to each other via connecting elements 5 located between the outer and inner supports 1*a*, 1*b*, 1*c*, 1*d*.

The term "load-bearing rope" also comprises "load-bearing rope strands" containing several individual load-bearing ropes.

The invention claimed is:

1. A safety net for rockfall protection barriers, the safety net comprising two outer supports;

at least two inner supports;

two outer bottom elements and at least two inner bottom elements configured to anchor the outer and the inner supports to a slope or rock;

an upper primary load-bearing rope tensioned laterally at both ends and a lower primary load-bearing rope tensioned laterally at both ends;

an upper secondary load-bearing rope tensioned laterally at both ends and a lower secondary load-bearing rope tensioned laterally at both ends;

upper rope guiding elements arranged at the upper ends of the outer and inner supports, wherein the upper primary load-bearing rope runs through the rope guiding elements of the outer supports;

lower rope guide elements arranged in the region of the outer and inner bottom elements, wherein the lower primary load-bearing rope runs through the rope guide elements of the outer bottom elements;

wherein the upper primary load-bearing rope runs through at least one upper rope guide element of the respective inner supports and bypasses the upper rope guide elements of the respective inner supports adjacent thereto;

wherein the upper secondary load-bearing rope runs through the upper rope guide elements of the outer supports and at least one upper rope guide element of an inner support and bypasses rope guide elements of adjacent inner supports, while the lower secondary load-bearing rope runs through the rope guide elements of the outer bottom elements and at least one rope guide element of an inner bottom element and bypasses the rope guide elements of the inner bottom elements adjacent thereto, such that each upper rope guide element of the inner supports and each lower rope guide element of the inner bottom elements is only run through by the primary load-bearing rope or the secondary load-bearing rope;

wherein the two upper load-bearing ropes and the two lower load-bearing ropes between adjacent outer and inner supports are in connection via a connecting element.

2. The safety net according to claim 1, wherein the safety net comprises at least one middle primary load-bearing rope and at least one associated middle secondary load-bearing rope;

wherein the safety net comprises pull elements extending perpendicularly thereto, which are longer than the inner supports and are fixed with their upper and lower ends to the upper and lower ends of the inner supports and are freely slidable relative to the middle primary and secondary load-bearing ropes and are provided with middle rope guide elements; and wherein the middle primary load-bearing ropes and the middle secondary load-bearing ropes respectively alternately either-run through adjacent middle rope guide elements.

3. The safety net according to claim 1, wherein the safety net comprises at least one middle primary load-bearing rope and at least one associated middle secondary load-bearing rope;

wherein the safety net comprises pull elements extending perpendicularly thereto, which are longer than the inner supports and are fixed with their upper and lower ends to the upper and lower ends of the inner supports and are freely slidable relative to the middle primary and secondary load-bearing ropes and are provided with middle rope guide elements; and wherein the middle primary load-bearing ropes and the middle secondary load-bearing ropes respectively alternately bypass adjacent middle rope guide elements.

* * * * *